US011548053B1

(12) United States Patent
Maga

(10) Patent No.: US 11,548,053 B1
(45) Date of Patent: Jan. 10, 2023

(54) DEVICE TO INSTALL SHOELACE AGLETS

(71) Applicant: Adam Maga, Indianapolis, IN (US)

(72) Inventor: Adam Maga, Indianapolis, IN (US)

( * ) Notice: Subject to any disclaimer, the term of this patent is extended or adjusted under 35 U.S.C. 154(b) by 0 days.

(21) Appl. No.: 17/571,903

(22) Filed: Jan. 10, 2022

Related U.S. Application Data

(60) Provisional application No. 63/135,507, filed on Jan. 8, 2021.

(51) Int. Cl.
*A43D 98/00* (2006.01)
*A43C 9/04* (2006.01)
*B21D 39/04* (2006.01)

(52) U.S. Cl.
CPC ..... *B21D 39/048* (2013.01); *A43D 98/00* (2013.01); *A43C 9/04* (2013.01)

(58) Field of Classification Search
CPC .... A43C 9/02; A43C 9/06; A43C 9/08; A43C 5/00; A43C 9/04; A43D 999/00; A43D 98/00; B21D 53/58; B21D 39/048; Y10S 425/807; B65B 63/06; G05B 2219/45194; Y10T 24/3787
See application file for complete search history.

(56) References Cited

U.S. PATENT DOCUMENTS

| | | | |
|---|---|---|---|
| 1,432,558 | A | 10/1922 | Jackson |
| 3,330,011 | A | 7/1967 | Michael, Jr. |
| 3,581,353 | A | 6/1971 | Sonntag |
| 5,832,574 | A | 11/1998 | Shin |
| 6,338,186 | B1 | 1/2002 | Kleinmann |
| 6,412,143 | B1 | 7/2002 | Chen |
| 6,427,298 | B1 | 8/2002 | Tseng |
| 6,470,542 | B1 | 10/2002 | Giannini |
| 7,251,868 | B2 | 8/2007 | Curet et al. |
| 8,852,373 | B2 | 10/2014 | Cheng |
| D741,675 | S | 10/2015 | Gibson, Jr. |
| D777,002 | S | 1/2017 | Carrington |
| 2005/0257355 | A1 | 11/2005 | Provenzale |
| 2008/0295305 | A1 | 12/2008 | Hsu |
| 2011/0131773 | A1 | 6/2011 | Hsieh |
| 2020/0085146 | A1 | 3/2020 | Lin |
| 2020/0154830 | A1 | 5/2020 | Cheng |

FOREIGN PATENT DOCUMENTS

| | | | | |
|---|---|---|---|---|
| CN | 201640692 | | 11/2010 | |
| EP | 1055378 | A2 * | 11/2000 | ..... A43C 9/00 |
| GB | 2379859 | | 3/2003 | |
| GB | 2379859 | A * | 3/2003 | ..... A43C 9/04 |

* cited by examiner

*Primary Examiner* — Lee A Holly
(74) *Attorney, Agent, or Firm* — John Rizvi; John Rizvi, P.A.—The Patent Professor ®

(57) ABSTRACT

A kit for installing a replacement aglet on a shoelace includes a cutting tool configured to cut a damaged distal tip section from the shoelace. A replacement aglet is positioned on the trimmed free end of the shoelace following the cutting operation. The replacement aglet has a split-sleeve construction including a longitudinal slit that extends fully from end to end. The slit makes it easy to locate the replacement aglet on the trimmed tip section of the shoelace. A heat applicator applies heat to the aglet-bearing shoelace and causes the aglet to compressively shrink in the manner of a shrink wrap process. The aglet functions as an article of shrink wrap tubing. The heating process fuses together the lengthwise edges of the slit and thereby closes the slit.

20 Claims, 7 Drawing Sheets

DEVICE TO INSTALL SHOELACE AGLETS

CROSS-REFERENCE TO RELATED APPLICATION

This application claims the benefit of co-pending U.S. Provisional Patent Application Ser. No. 63/135,507 filed Jan. 8, 2021, which is incorporated herein in its entirety.

FIELD OF THE INVENTION

The present invention relates generally to a machine for installing shoelace aglets, and more particularly, to an all-in-one installation kit that integrates all of the operations needed to repair the shoelace, including a trimming process to remove unwanted portions from the end of the shoelace and an attachment process to apply an aglet to the trimmed end.

BACKGROUND OF THE INVENTION

Ancient civilizations differed quite significantly in many regards to those that originated thousands of years later. This is true of its societal structure, economic development, behavioral patterns, ideology, and survival. There are also indications that the ideas surrounding, for example, survival, did not evolve as expected. Apart from the weapons used to kill game and feed the village, the development of other survival tools suffered a stagnant advancement. Notably, shelter, clothing, footwear, and other forms of protection have remained antiquated in idea and execution. For example, there is striking semblance between footwear worn in 3000 BC to those worn in 1850 AD—however, there are significant differences between weapon advancement spanning those same dates, both in appearance and function.

This discrepancy may be attributed to the original footwear design being sufficiently adequate for its purpose to last thousands of years relatively unchanged. When it comes to weaponry, more efficient methods of killing game provided more adequate quality of life and thus precipitated evolvement. Although footwear function has remained relatively consistent through generations, its other facet—fashion—has seen major innovations. This is not surprising, as its uniqueness is one of its few sources of value—and valuable it is. According to Statista, the revenue generated by the footwear market in the United States alone was approximately $79 billion in 2017. Being a subset of apparel industry, which drew revenue of 260 billion in 2017 in store sales throughout the US, its societal value and importance is substantial. To this point, a monumental steppingstone of a child's development is determined by their ability to tie their shoelaces.

Footwear design has remained largely unaltered for thousands of years, and its longevity has not seen significant improvement either. This is especially true when considering shoelaces, which often experience wear and tear more frequently than the shoes themselves. For example, shoelaces are meant to be tied tightly as to not become undone when the individual walks. This frequent tightening of the shoelaces expedites its wear. Furthermore, some shoelaces are made longer than necessary to accommodate different tying styles or preferences. This will cause them to hang low enough to scrape the floor or be stepped on, leading to further deterioration. When expensive footwear experiences shoelace damage, such as a complete tear or the loosening of the aglet used to keep the end of the shoelace from unraveling, replacement is often an afterthought to repair.

Accordingly, there is an established need for a machine to provide the full range of operations needed to repair a shoelace, which addresses a broad range of repair conditions necessitating shoelace renewal, such as a damaged or missing aglet, an insecure attachment of the aglet to the shoelace, and fraying of the shoelace at the aglet end.

SUMMARY OF THE INVENTION

The present invention is directed to a shoelace aglet attachment kit that permits easy attachment of an aglet to the end of a shoestring. The kit includes a cutting unit configured to remove an end section of the shoelace and thereby shorten it, which occurs in the event the shoelace tip is damaged or otherwise in need of repair. The trimmed end of the shoelace serves as the new location for attaching a replacement aglet. Once the replacement aglet is located on the trimmed end of the shoelace, a heating unit applies heat to the aglet-bearing shoelace and causes the aglet to fasten and otherwise firmly attach to the shoelace in the manner of a shrink wrap process. The aglet effectively functions as an article of heat shrink tubing. For ease of attachment, the replacement aglet has a split-sleeve construction defined by a longitudinal slit that extends fully from end to end of the aglet sheath. The slit enables the aglet to open and easily slide over the trimmed free end of the shoelace. The heating process fuses the lengthwise edges of the slit together, thereby closing and sealing the slit. The heating process compresses the replacement aglet in place on the tip of the shoelace, providing a tight, sealing, fastened relationship between the replacement aglet and shoelace at its trimmed tip section.

Introducing a first embodiment of the invention, the present invention consists of a kit for renewing a shoelace, comprising:

- a housing having an upper end and a lower end removably mounted to one another to provide an interior space;
- a shoelace-cutting subassembly housed within the interior spacing of the housing, the shoelace-cutting subassembly including a receptacle and cutting tool for performing a cutting operation; and
- an aglet-attaching subassembly housed within the interior spacing of the housing and opposite to the shoelace-cutting assembly, the aglet-attaching subassembly including a receptacle and a joining applicator that is configured to perform an aglet joining operation.

In another aspect, the shoelace-cutting subassembly may comprise a first receptacle defining a hollow elongated tubular body having an interior shoelace-receiving space for receiving the tip portion of the shoelace, and a cutting tool including a movable cutting implement having a cutting edge, the cutting edge tool configured to allow the cutting implement to advance transversely across a portion of the first receptacle to cut the tip portion off the shoelace.

In another aspect, the aglet-attaching subassembly may comprise a second receptacle defining a hollow elongate tubular body having an interior shoelace-receiving space, and a heat applicator operably disposed about the second receptacle to induce a heat shrink relationship between an aglet and an aglet-ready tip portion of the shoelace.

In another aspect, the heat applicator may comprise a heating coil annularly disposed about the second receptacle extending a distance lengthwise along the longitudinal axis of the tubular body of the second receptacle.

In another aspect, the device may further include a power supply unit and an onboard electronic circuit in electronic communication with the aglet-attaching subassembly and the shoelace-cutting subassembly, the onboard electronic circuit holding a series of executable instructions held in memory that are executable by the aglet-attaching subassembly and the shoelace-cutting subassembly.

In another aspect, the invention may comprise a kit for renewing a shoelace, comprising:

an aglet having a split sheath construction;

a shoelace-cutting subassembly configured to selectively cut the shoelace to define a trimmed end of the shoelace;

the shoelace-cutting assembly including:

a first receptacle defining a hollow elongate tubular body having an interior shoelace-receiving space, the first receptacle having a proximal section, a distal section, and a clearance space gap section disposed between the proximal section and the distal section, and a cutting tool including a movable cutting implement having a cutting edge, the cutting tool configured to allow the cutting implement to advance through the clearance space gap section and effectuate a cutting action on an occupant of the gap section;

an aglet-attaching subassembly configured to receive an aglet-bearing shoelace and to process the aglet-bearing shoelace to effectuate attachment of the aglet to the shoelace;

the aglet-attaching subassembly including:

a second receptacle defining a hollow elongate tubular body having an interior shoelace-receiving space, and a heat applicator configured to apply heat to the aglet-bearing shoelace operably disposed in the second receptacle and to thereby induce a heat shrink relationship between the aglet and the shoelace.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a kit or machine adapted to install an aglet on a shoelace. The kit effectively renews the shoelace. The kit provides a functionality to first prepare the shoelace for aglet attachment, including a trimming operation that cuts the original aglet section from the shoelace to produce a clean free end or trimmed tip section that will subsequently receive the new replacement aglet. The kit provides another functionality to attach the replacement aglet to the shoelace at the clean free end. This attachment process, in one form, performs a shrink wrap operation in which the aglet is secured to the tip section of the shoelace in the form of heat shrink tubing.

Figure 1:
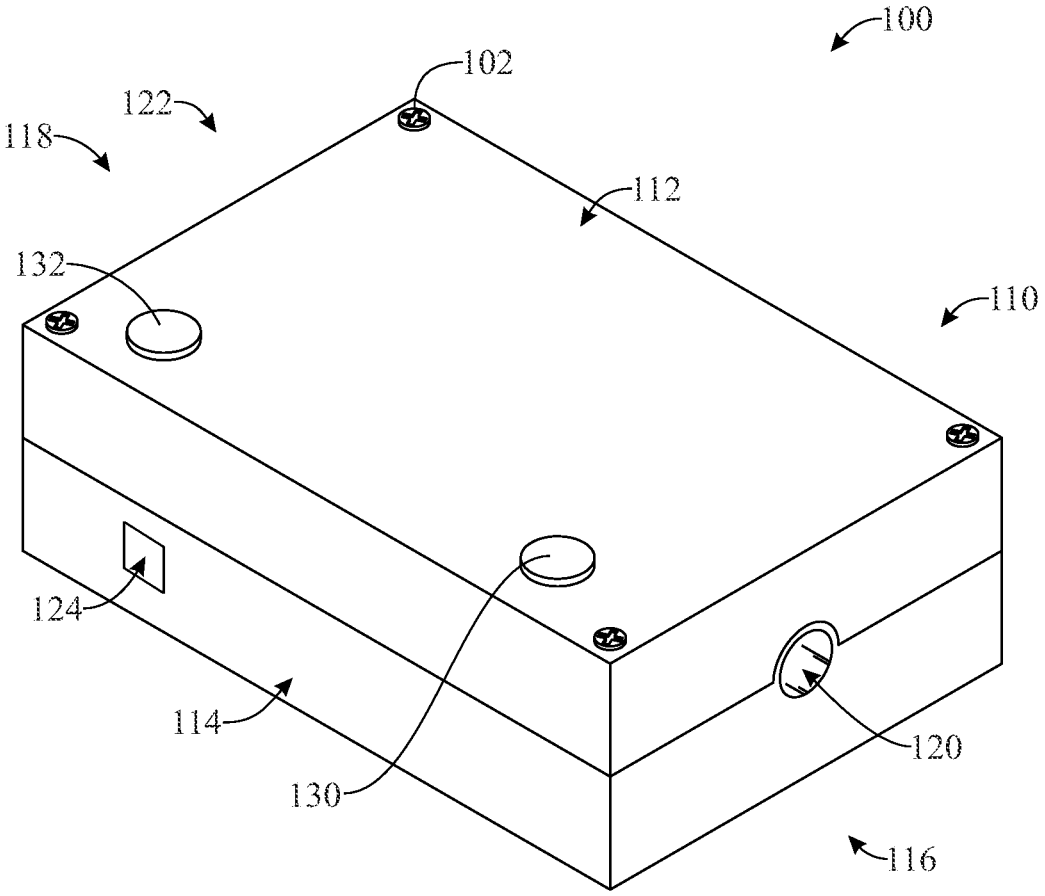
FIG. 1 presents an upper perspective view showing a first embodiment of the shoelace repair kit of the present invention, illustrating the housing in its closed position with a set of apertures or portals adapted to receive a shoelace workpiece to facilitate cutting and curing operations.
Figure 2:
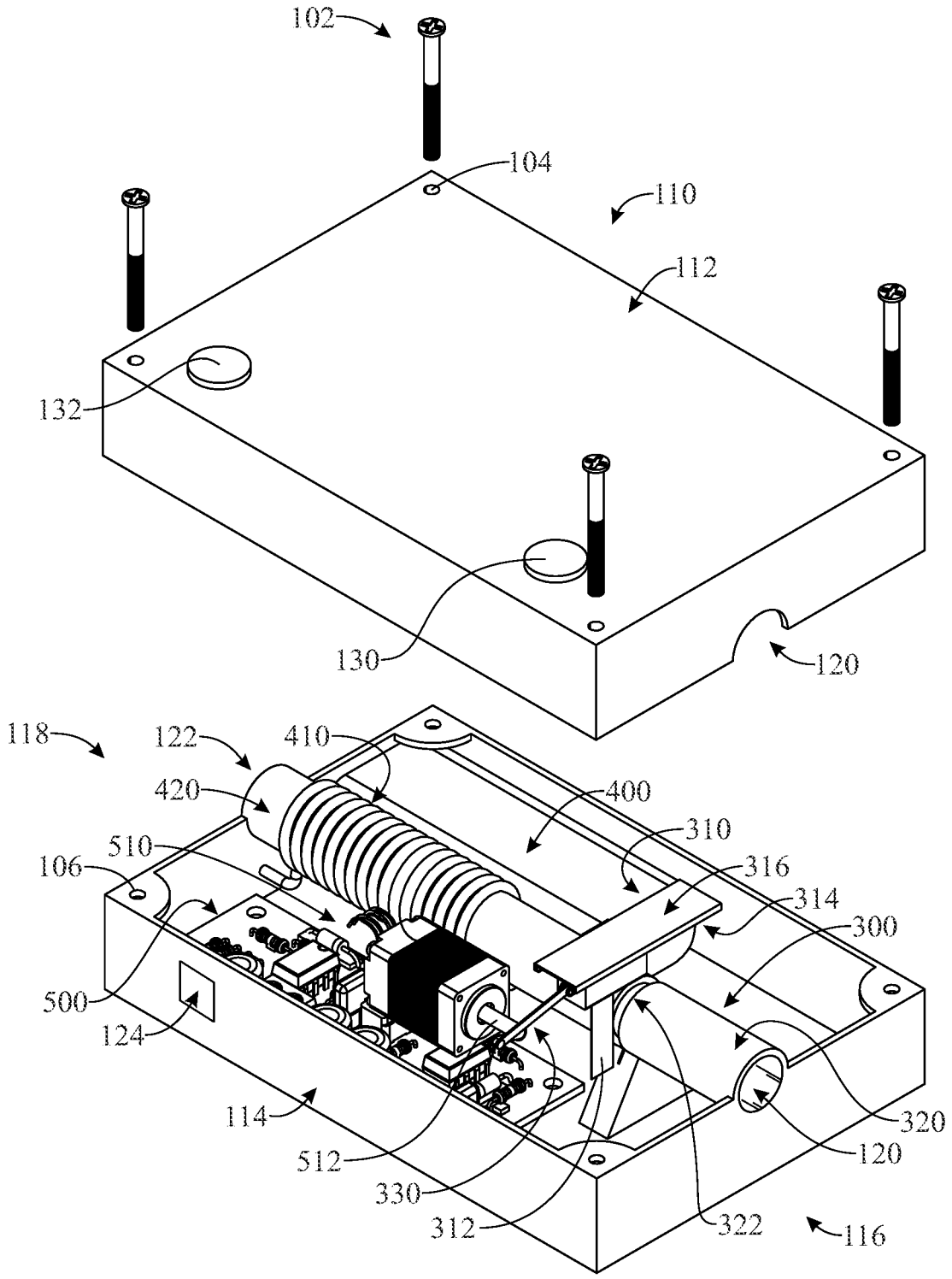
FIG. 2 presents an upper diagrammatic perspective view of the first embodiment of the shoelace repair kit of the present invention, showing the device with the housing cover removed to illustrate the interior arrangement of components.

Referring initially to FIG. 1, a shoelace repair kit 100 is disclosed, according to a first embodiment of the present invention. The kit 100 includes an enclosure or box-type housing 110 that includes an upper end or top 112 and a lower end or bottom 114. The top 112 is removably mounted to the bottom 114 using a set of hold-down securing screws 102 that thread from above into mounting flanges 106 located at the inside corners of bottom 114 (FIG. 2) via mounting holes 104 in top 112. Any other suitable conventional means can be used to removably mount top 112 to bottom 114. The kit 100 includes a cutting side 116 having an aperture or portal 120 through which a shoelace is guided to facilitate a cutting operation performed by a shoelace cutting unit or subassembly 300 housed in kit 100 (FIG. 2). A user-operable control or cutting actuation selector 130 is provided in top 112, which the user can access and engage to initiate the automatic cutting operation. The kit 100 further includes an aglet attachment side 118 having an aperture or portal 122 (not visible but see FIG. 7) through which a shoelace is guided to facilitate an aglet attachment operation performed by an aglet attachment unit or subassembly 400 housed in kit 100 (FIG. 2). A user-operable control or aglet-attachment actuation selector 132 is provided in top 112, which the user can access and engage to initiate the automatic aglet-attachment operation. As discussed further, an external USB port 124 is furnished in housing 110 and adapted to supply power to the electronics housed in kit 100.

Figure 8:
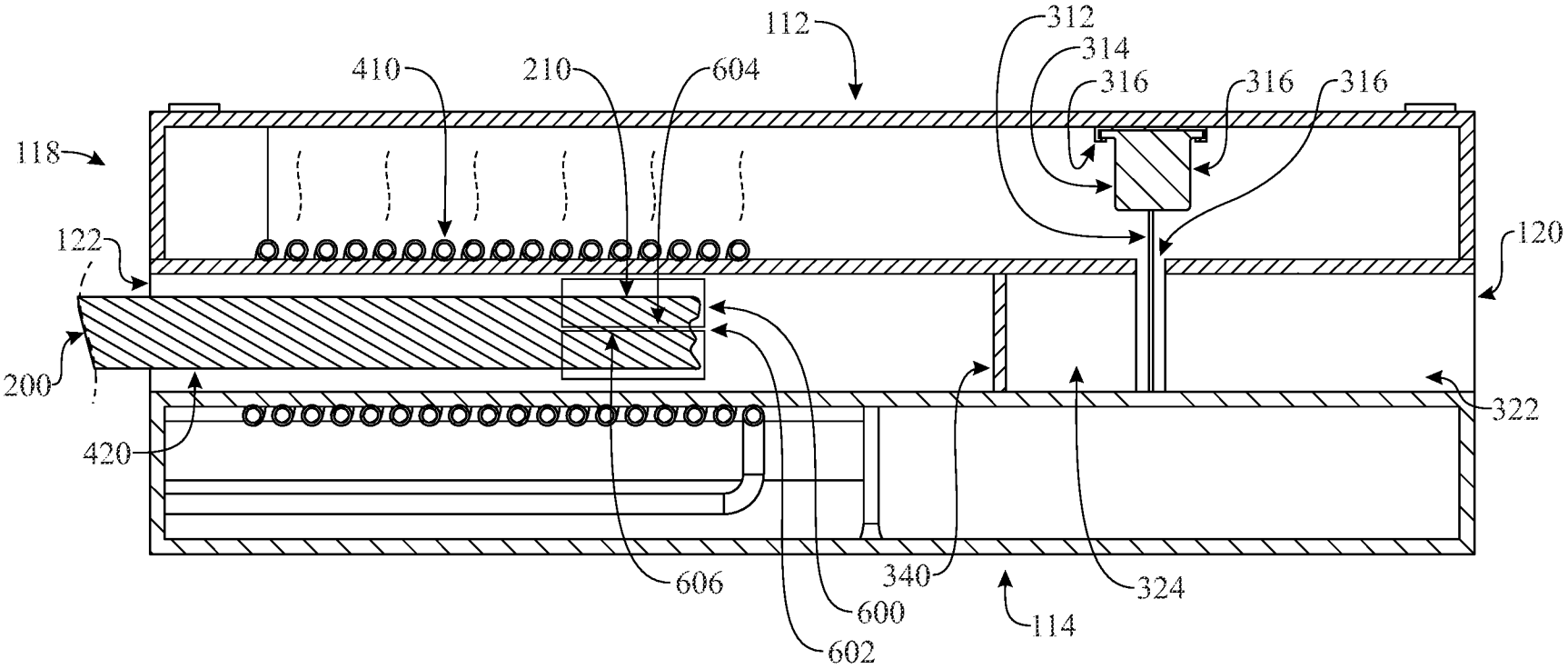
FIG. 8 presents a cross-sectional, interior diagrammatic view of the first embodiment of the shoelace repair kit of the present invention, taken along lines 7-7 of FIG. 7, illustrating how an aglet is attached and secured to the end of the shoelace.

Referring now to FIG. 2, with brief reference to FIG. 8, the components of kit 100 are now disclosed in more detail. The shoelace cutting subassembly generally illustrated at 300 includes, in combination, a cutting tool generally illustrated at 310 and a shoelace receptacle generally illustrated at 320. As discussed further, the cutting tool 310 is configured to perform a trimming operation on a shoelace 200 (FIG. 3) received within receptacle 320, in which a tip section 202 of the shoelace 200 is excised and otherwise removed in order to create a new tip section where a replacement aglet is installed by the aglet attachment subassembly 400. The receptacle 320 defines a hollow, generally elongate tubular body having an interior shoelace-receiving space. In one form, the receptacle 320 has a cylindrical construction. This interior space of receptacle 320 includes a proximal section 322, a distal section 324, and a clearance space gap section 326 disposed between the proximal section 322 and the distal section 324 (FIG. 8). The portal 120 forms the mouth of receptacle 320 at the opening of proximal section 322. The receptacle 320 forms a holder or guide to receive a workpiece, namely, a shoelace under repair. The shoelace 200 is located within receptacle 320 so that the distal section 324 of receptacle 320 is occupied by the shoelace tip portion 202 designated for removal. After the cutting operation, the distal section 324 contains the damaged shoelace item 202 (removed portion of shoelace) and hence defines a disposal space. As discussed further, the gap section 326 of receptacle 320 defines a cutting zone through which the cutting implement of cutting tool 310 is maneuvered in order to perform a cutting operation on the portion of the shoelace resident in gap section 326. Prior to the cutting operation, the shoelace 200 is disposed and otherwise maneuvered into place in receptacle 320, extending through proximal section 322, across gap section 326, and into distal section 324. In the gap section 326, the shoelace 200 is exposed to facilitate access to it by the cutting implement of cutting tool 310.

Figure 5:
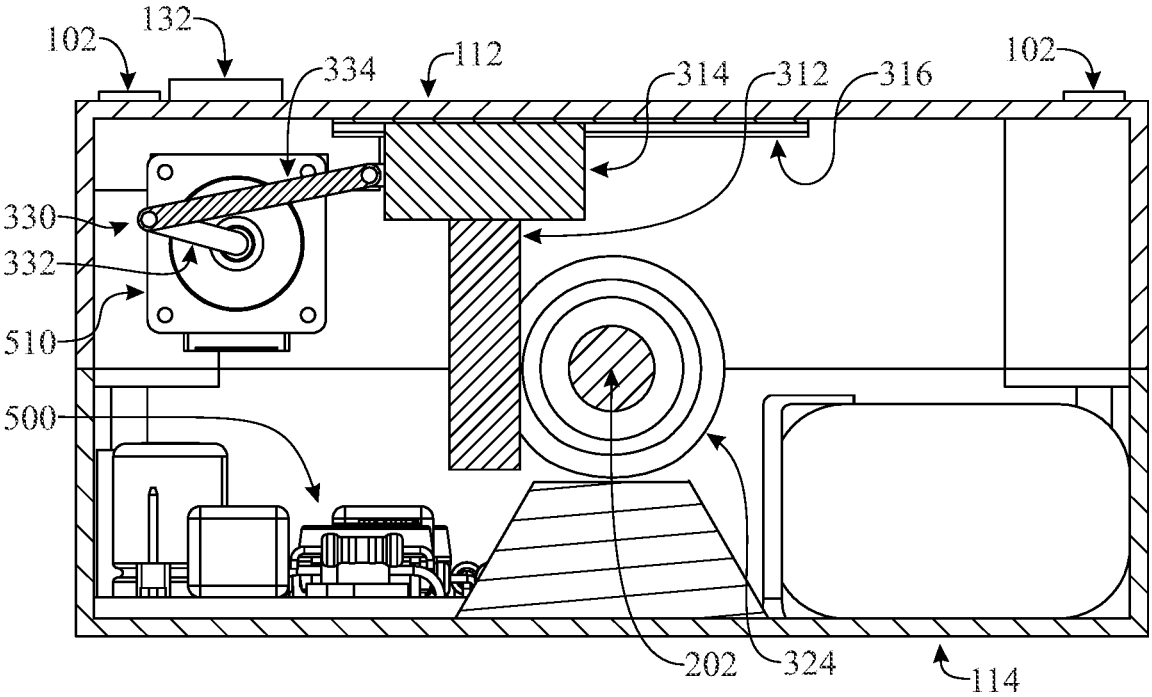
FIG. 5 presents a cross-sectional, interior diagrammatic view of the first embodiment of the shoelace repair kit of the present invention, taken along lines 5-5 of FIG. 4, illustrating how the cutting tool is initially oriented relative to a shoelace prior to inception of a cutting process.
Figure 6:
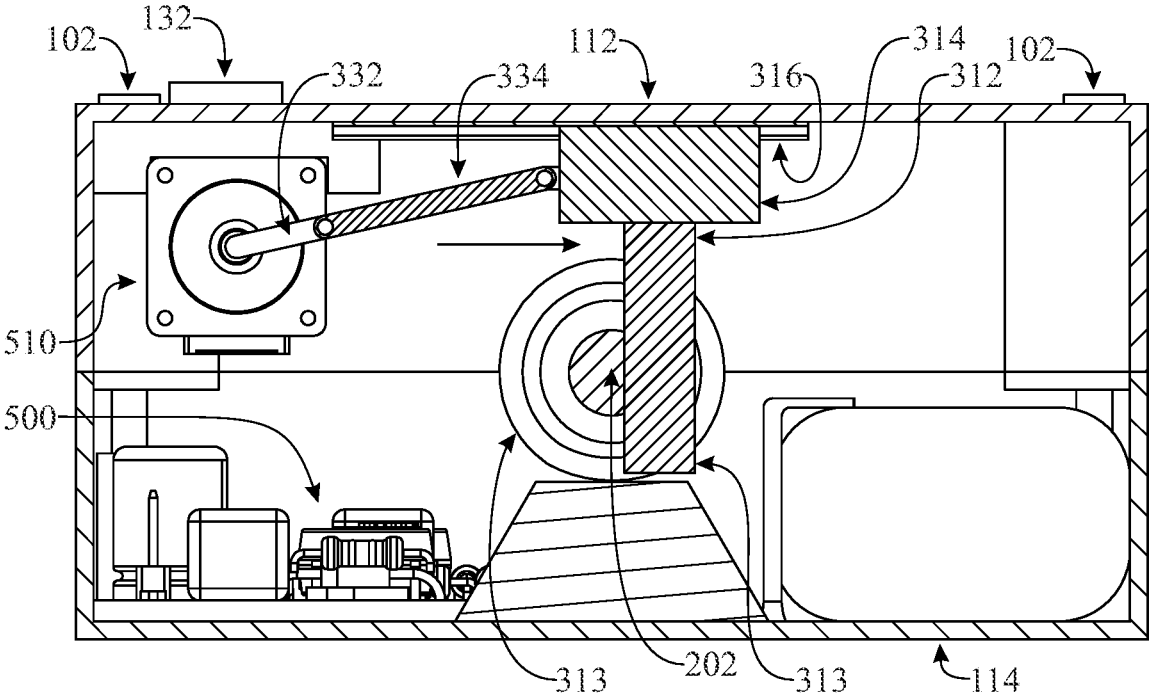
FIG. 6 presents a cross-sectional, interior diagrammatic view of the first embodiment of the shoelace repair kit of the present invention, taken along lines 5-5 of FIG. 4, illustrating actuation of the cutting tool to perform a cutting operation, following the step shown in FIG. 5.

Referring still to FIG. 2, in addition to FIGS. 5-6 and 8, the cutting tool 310 includes, in combination, a cutting implement 312, a movable knife carrier 314, and a carrier guide or track 316. The cutting implement 312 is provided in the form of a knife or blade having a cutting edge 313 (FIG. 6). For example, the cutting implement 312 can be a ½ inch sized razor. The knife carrier 314 supports and carries the cutting implement 312, which depends downwardly from knife carrier 314. At the underside of housing top 112, a carrier-guiding track 316 is mounted and extends laterally. The knife carrier 314 is adapted to be slidably supported at its upper end by track 316. During operation, the knife carrier 314 slidably moves within track 316 in the lateral direction. The track 316 guides the lateral translation of knife carrier 314. In this manner, the cutting implement 312, which moves in tandem with knife carrier 314, is able to undergo a lateral translation. The cutting tool 310 is suitably size, shaped, and positioned so that the cutting implement 312 is laterally aligned with the gap section 326 of shoelace-receiving receptacle 320 (FIG. 8). During operation, as knife carrier 314 moves in the lateral direction, cutting implement 312 moves through gap section 326 with cutting edge 313 as the leading edge, allowing it to engage and cut an object (shoelace 200) present in gap section 326.

The kit 100 further includes an articulated linkage assembly generally illustrated at 330 that drives the lateral motion of knife carrier 314 of cutting tool 310. The linkage 330 is provided in the form of a slider-crank mechanism that is configured to transform rotary motion into linear or translation motion. The linkage assembly 330 is driven by a motor assembly generally illustrated at 510. The motor assembly 510 includes a rotary motor drive arm 512. The linkage assembly 330 includes a first motor-driven arm or link 332 and a second tool-driving arm or link 334. The links 332, 334 are pivotally connected to one another. The first link 332 is connected at one end to the rotary motor drive arm 512 of motor assembly 510 and at another end to second link 334. The second link 334 is pivotally connected at one end to first link 332 and at another end to carrier 314 of cutting tool 310. The linkage assembly 330 is configured to convert the rotary motion of motor drive arm 512 into a translation motion that drives a reciprocating linear displacement of knife carrier 314 (and cutting implement 312). Referring to the operating sequence shown in FIGS. 5 and 6, the linkage assembly 330 initially is in a retracted position. In response to the operation of motor assembly 510, the motor drive arm 512 rotates (e.g., clockwise in the depicted orientation) and imparts a pivoting action to first link 332, causing the first link 332 to pivot about the axis of motor drive arm 512. As shown in FIG. 6, continued pivoting of the motor-driven first link 332 drives the tool-driving second link 334, which in turn exerts a driving translation and linear displacement of knife carrier 314. This driven translation of knife carrier 314 causes the attached cutting implement 312 to displace through gap section 326 of shoelace receptacle 320 and effectuate a cutting action on shoelace 200 disposed therein. FIG. 6 shows the linkage assembly 330 in a fully extended position illustrating the range of movement of knife carrier 314. Further operation of motor assembly 510 causes the linkage assembly 330 to reconfigure its pivoting relationship and retract cutting tool 310.

Referring again to FIG. 2, with additional reference to FIG. 8, the aglet attachment subassembly generally illustrated at 400 includes, in combination, a heat applicator generally illustrated at 410 and a shoelace receptacle generally illustrated at 420. As discussed further, the heat applicator 410 is configured to apply heat to the aglet-bearing shoelace 200 located within receptacle 420 in order to perform a heat-shrink tubing activity on aglet 600 so that aglet 600 sealably attaches to shoelace 200 in the manner of a shrink-wrap relationship. The receptacle 420 defines a hollow, generally elongate tubular body having an interior shoelace-receiving space. In one form, the receptacle 420 has a cylindrical construction. For design convenience, the shoelace receptacle 420 of aglet attachment subassembly 400 is generally coaxial with the shoelace receptacle 320 of shoelace cutting subassembly 300. The receptacles 320, 420 are preferably separated by a partition or divider 340. The portal 122 forms the mouth of receptacle 420 to permit access and passageway of shoelace 200 into receptacle 420. The receptacle 420 forms a holder or guide to receive a workpiece, namely, a shoelace under repair.

In one implementation, the heat applicator 410 is provided in the form of an elongate heating coil annularly disposed about shoelace receptacle 420. The heating coil 410 extends lengthwise an amount sufficient to apply heat to shoelace 200 disposed in receptacle 420, particularly at the tip section where replacement aglet 600 is located. As discussed further, during operation, the heating coil 410 is energized, causing the heat element of heating coil 410 to be heated (rise in temperature), which heats the surrounding ambient environment through a process of emitted radiant energy. Heat transfer from the heating coil 410 to the replacement aglet 400 disposed on shoelace 200 will occur by a process of convection.

Referring now to FIGS. 3-6, the shoelace-cutting mechanism 300 and its operation are now disclosed in more detail. The shoelace repair kit 100 includes a control mechanism generally illustrated at 500 that performs all of the control functionalities needed to operate the shoelace cutting subassembly 300 and the aglet attachment subassembly 400. Any suitable means can be used to implement control mechanism 500, such as a printed circuit board and other electronic circuitry. The control mechanism 500 operates the cutting tool 310 in response to user activation of the shoelace-cutting actuation selector 130. Additionally, the control mechanism 500 operates the heating coil 410 in response to user activation of the aglet-heating actuation selector 132.

Figure 3:
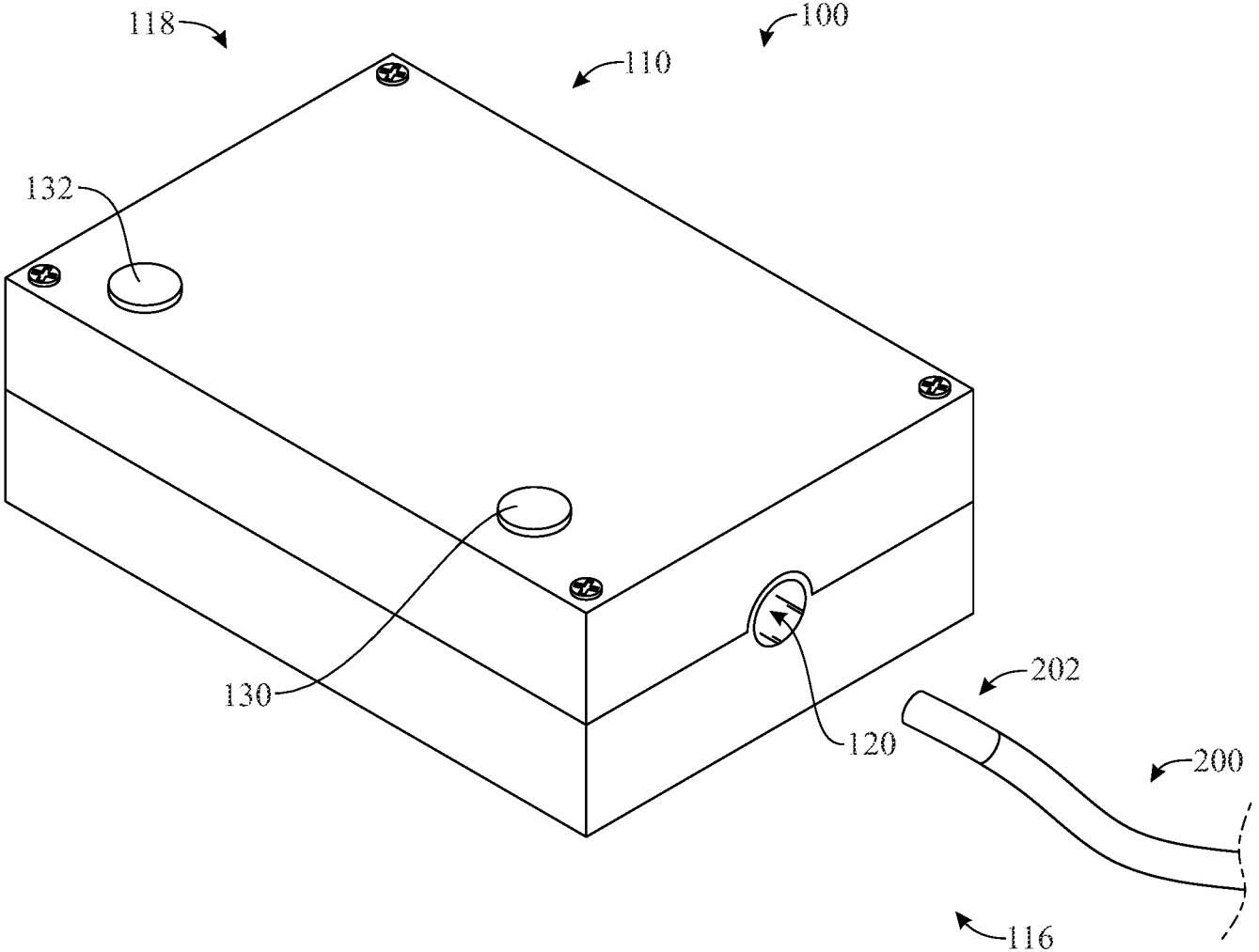
FIG. 3 presents an upper perspective view of the first embodiment of the shoelace repair kit of the present invention, illustrating how the device receives a shoelace in need of renewal at its cutting side aperture.
Figure 4:
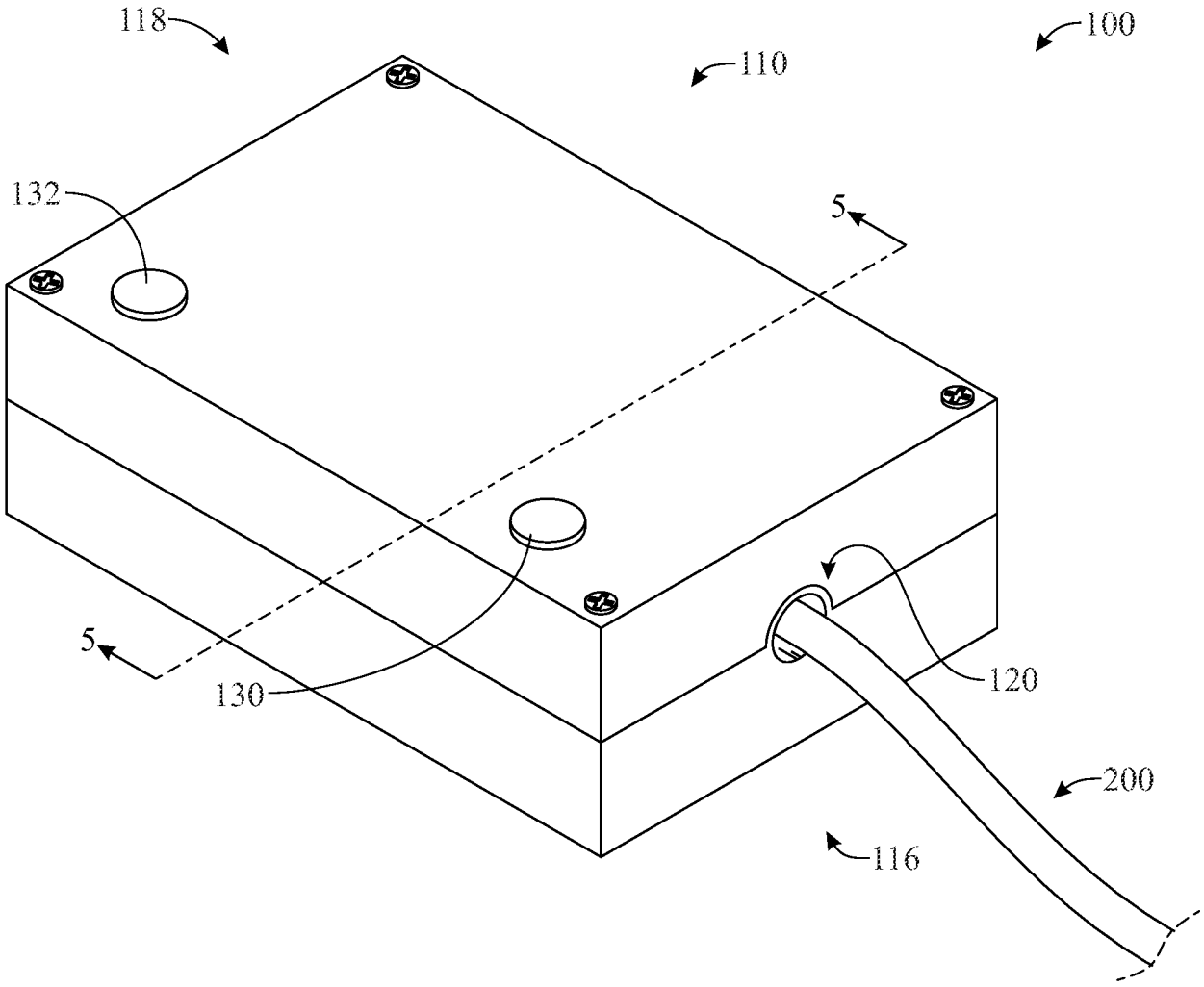
FIG. 4 presents an upper perspective view of the first embodiment of the shoelace repair kit of the present invention, illustrating how the shoelace depicted in FIG. 3 is inserted into the cutting-side aperture as part of a cutting operation.

A shoelace 200 under repair includes a damaged distal repair section 202 that needs to be removed in order to make room for the new replacement aglet 600 (FIG. 3). The user slides shoelace 200 into receptacle 320 until the repair section 202 is suitably located in the distal shoelace-disposal section 324 of receptacle 320, such that the transition between shoelace repair section 202 and the main body of shoelace 200 is disposed and otherwise exposed in the cutting zone defined by the clearance space gap section 326 (FIGS. 4 and 5). The distal repair section 202 can exhibit a variety of conditions requiring removal, such as a damaged aglet (e.g., broken or loose) or the absence of an aglet.

To initiate the shoelace cutting process, the user activates the cutting actuation selector 130. This user-controlled activation directs the control mechanism 500 to actuate motor assembly 510, which in turn directs the operation of linkage assembly 330, causing the cutting implement 312 to translate in the manner shown by FIGS. 5 and 6 and completely sever and otherwise separate the damaged shoelace tip 202 from the main shoelace body. Now separated from the main body of shoelace 200, the removed damaged shoelace tip 202 lies alone in distal section 324 of receptacle 320 and can subsequently be taken out and discarded. The cutting tool 310 is suitably configured so that removal of the damaged shoelace tip 202 can occur with a single cutting action of cutting implement 312. Due to the cutting operation, the shoelace 200 now has a fresh, trimmed end section or tip 210 where the replacement aglet 600 can be attached using aglet attachment subassembly 400 (FIG. 8).

The replacement aglet 600 can be provided in any suitable form. As conventionally known, an aglet is a small sheath, typically made of plastic or metal, used on each end of a shoelace, cord, or drawstring. The aglet keeps the fibers of the lace or cord from unraveling; its firmness and narrow profile make it easier to hold and easier to feed through eyelets, lugs, or other lacing guides. In one implementation, the aglet 600 has a generally tubular, split sleeve construction defining a lumen. The split-sleeve aglet 600 includes a closable lengthwise slit 602 that extends longitudinally from end to end along the aglet body and defines a pair of opposing longitudinal edges 604, 606 (FIG. 8). After removing the trimmed shoelace 200 from receptacle 320 (following the cutting operation), the user manually places the split-sleeve aglet 600 over the trimmed end 210 of shoelace 200, so that aglet 600 is annularly disposed about the trimmed shoelace end 210. The split-sleeve construction of aglet 600 allows the user to open the replacement aglet and fit it over the trimmed shoelace end 210, making it easier to locate and otherwise position the replacement aglet 600 on the trimmed shoelace tip 210. The aglet-bearing shoelace is now prepared for the next operation, namely, the process performed by aglet attachment subassembly 400 to cause secure attachment of aglet 600 to the trimmed shoelace.

Figure 7:
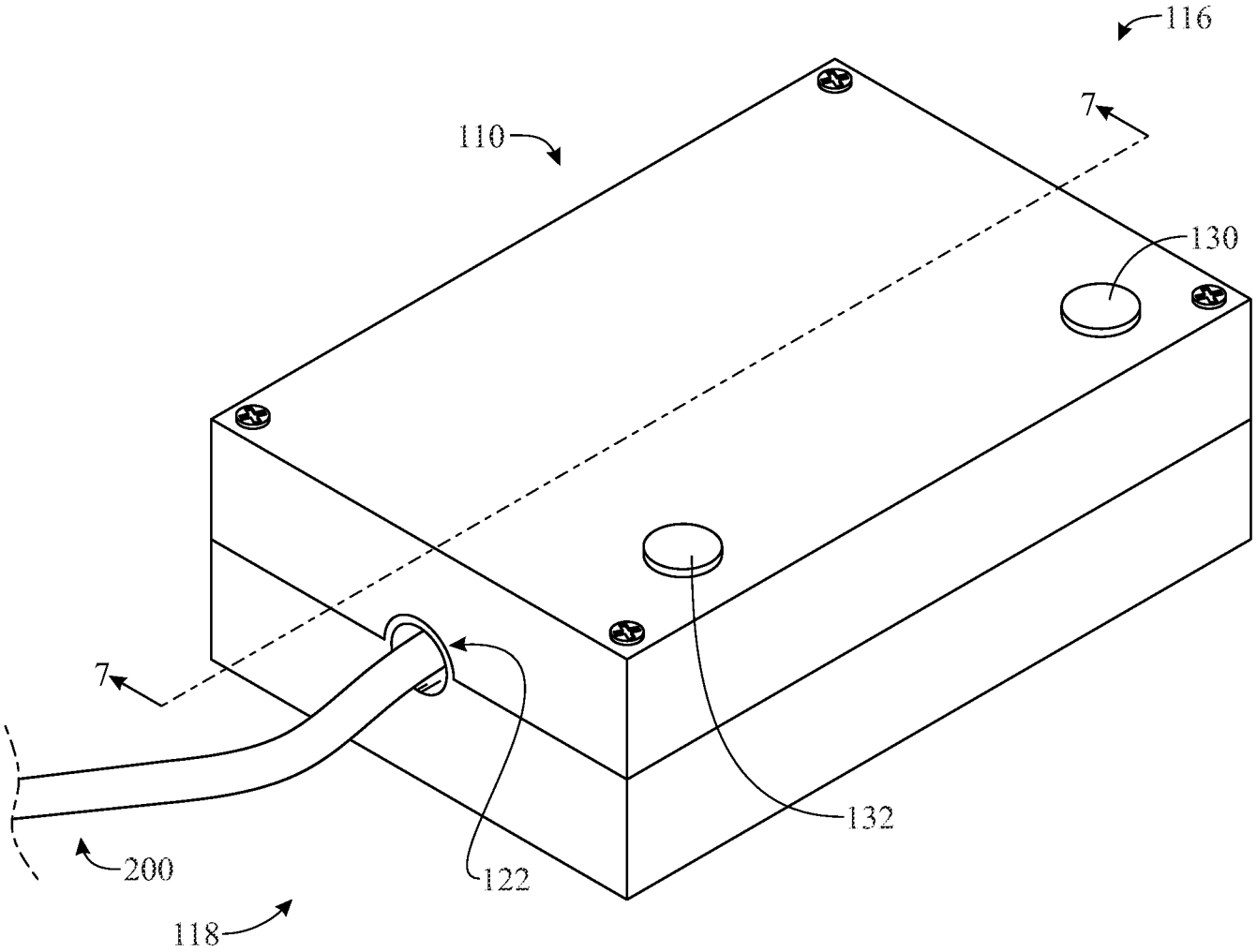
FIG. 7 presents an upper perspective view of the first embodiment of the shoelace repair kit of the present invention, illustrating how a shoelace is inserted into the curing-side aperture as part of a curing operation, following the cutting operation shown in FIGS. 4-6.

Referring now to FIGS. 7-8, the aglet-attachment mechanism 400 and its operation are now disclosed in more detail. Following the cutting operation performed by the shoelace cutting subassembly 300, the user places the split-sleeve replacement aglet 600 over the trimmed distal end 210 of shoelace 200. The aglet-bearing shoelace 200 is then positioned within receptacle 420, with the trimmed distal end 210 occupying the leading position advanced into receptacle 420. The user activates operation of the heating coil 410 by activating the user-operable heating actuation selector 132, which provides a control signal to electronic control circuitry 500. The control circuitry 500, in response to the control signal generated by selector 132, directs the operation of heating coil 410. The control circuitry 500 manages various operating parameters of heating coil 410, such as temperature and duration/schedule of curing period. In response to the replacement aglet 600 being adequately heated by heating coil 410, the first longitudinal edge 604 and second longitudinal 606 fuse together to close the lengthwise slit 600 originally formed in replacement aglet 600. Further heating of replacement aglet 600 causes the aglet 600 to adhere or attach to shoelace 200 in the manner of a shrink wrap process, so that replacement aglet 600 effectively serves as an article of heat shrink tubing. The replacement aglet 600, in response to the application of heat, shrinks sufficiently to wrap compressively and tightly around the trimmed end 210 of shoelace 200, completing the repair and renewal process. The heat processed aglet 600 forms a firm sealing engagement with the shoelace 200 at its trimmed end tip section 210. The renewed aglet-bearing shoelace 200 can now be removed from receptacle 420 and put into use.

The kit 100 is a compact unit integrating various functionalities to perform a repair and renewal process on a damaged shoelace. The kit 100 is easy to transport and operate. The power requirements of kit 100 are supported by a USB port that can be connected to an external power supply (e.g., wall outlet) to charge a rechargeable battery used to power the onboard electronic control circuitry 500. The kit 100 is able to accommodate repairs to any sized or shaped shoelace. For this purpose, the user can deploy customized aglets 600 of any size and shape that are suited to the shoelace workpiece.

Since many modifications, variations, and changes in detail can be made to the described preferred embodiments of the invention, it is intended that all matters in the foregoing description and shown in the accompanying drawings be interpreted as illustrative and not in a limiting sense.

Furthermore, it is understood that any of the features presented in the embodiments may be integrated into any of the other embodiments unless explicitly stated otherwise. The scope of the invention should be determined by the appended claims and their legal equivalents.

What is claimed is:

1. A device for renewing a shoelace, comprising:

a housing having an upper end and a lower end removably mounted to one another and providing an interior space;

a shoelace-cutting subassembly housed within the interior spacing of the housing, the shoelace-cutting subassembly includes a receptacle and cutting tool for performing a cutting operation; and an aglet-attaching subassembly housed within the interior spacing of the housing, the aglet-attaching subassembly includes a receptacle and a joining applicator that is configured to perform an aglet joining operation.

2. The device of claim 1, wherein the shoelace-cutting subassembly comprises, a first receptacle defining a hollow elongated tubular body having an interior shoelace-receiving space for receiving the tip portion of the shoelace; and a cutting tool including a movable cutting implement having a cutting edge, the cutting edge tool configured to allow the cutting implement to advance transversely across a portion of the first receptacle to cut the tip portion off the shoelace.

3. The device of claim 2, wherein the first receptacle includes a proximal section, a distal section, and a clearance space gap section disposed between the proximal section and the distal section.

4. The device of claim 3, wherein the cutting implement advances through the clearance space gap section and effectuates a cutting action on the tip portion of the shoelace.

5. The device of claim 2, wherein the cutting tool comprises a motor assembly including a motor driving a motor drive arm attached to the cutting implement.

6. The device of claim 5, wherein the motor drive arm includes a plurality of linkages that convert the rotary motion of the motor into translational motion for the cutting implement.

7. The device of claim 1, wherein the aglet-attaching subassembly comprises, a second receptacle defining a hollow elongate tubular body having an interior shoelace-receiving space; and a heat applicator operably disposed about the second receptacle to induce a heat shrink relationship between an aglet and an aglet-ready tip portion of the shoelace.

8. The device of claim 7, wherein the heat applicator is a heating coil annularly disposed about the second receptacle extending a distance lengthwise along the longitudinal axis of the tubular body of the second receptacle.

9. The device of claim 7, wherein the power supply unit is a rechargeable battery.

10. The device of claim 1, wherein the cutting operation includes receiving a tip portion of the shoelace and cutting the tip portion off the shoelace to provide an aglet-ready tip portion.

11. The device of claim 1, wherein the aglet joining operation includes receiving an aglet-ready tip portion within the receptacle and with use of the joining applicator joining an aglet to the aglet-ready tip portion.

12. The device of claim 1, wherein the device further includes a power supply unit and an onboard electronic circuit in electronic communication with the aglet-attaching subassembly and the shoelace-cutting subassembly, the onboard electronic circuit holding a series of executable instructions held in memory that are executable by the aglet-attaching subassembly and the shoelace-cutting subassembly.

13. The device of claim 1, wherein the device includes a first actuation switch provided about a top portion of the upper end of the housing, the actuation switch when engaged initiates the cutting operation.

14. The device of claim 1, wherein the device includes a second actuation switch provided about a top portion of the upper end of the housing, the actuation switch when engaged initiates the aglet joining operation.

15. A device for renewing a shoelace, comprising:

a housing having an upper end and a lower end removably mounted to one another and providing an interior space;

a shoelace-cutting subassembly housed within the interior spacing of the housing, the shoelace-cutting subassembly includes a receptacle and cutting tool for performing a cutting operation;

an aglet-attaching subassembly housed within the interior spacing of the housing, the aglet-attaching subassembly includes a receptacle and a joining applicator that is configured to perform an aglet joining operation; and a power supply unit powering the shoelace-cutting subassembly and the aglet-attaching subassembly.

16. The device of claim 15, wherein the shoelace-cutting subassembly comprises, a first receptacle defining a hollow elongated tubular body having an interior shoelace-receiving space for receiving the tip portion of the shoelace; and a cutting tool including a movable cutting implement having a cutting edge, the cutting edge tool configured to allow the cutting implement to advance transversely across a portion of the first receptacle to cut the tip portion off the shoelace.

17. The device of claim 15, wherein the aglet-attaching subassembly comprises, a second receptacle defining a hollow elongate tubular body having an interior shoelace-receiving space; and a heat applicator operably disposed about the second receptacle to induce a heat shrink relationship between an aglet and an aglet-ready tip portion of the shoelace.

18. The device of claim 15, wherein the device includes a first actuation switch and a second activation switch provided about a top portion of the upper end of the housing, the first and the second actuation switch when engaged initiates the cutting operation and the joining operation, respectively.

19. The device of claim 15, wherein the cutting tool comprises a motor assembly including a motor driving a motor drive arm attached to the cutting implement, and the motor drive arm includes a plurality of linkages that convert the rotary motion of the motor into translational motion for the cutting implement.

20. A kit for renewing a shoelace, comprising:

an aglet having a split sheath construction;

a shoelace-cutting subassembly configured to selectively cut the shoelace to define a trimmed end of the shoelace;

the shoelace-cutting assembly including:

a first receptacle defining a hollow elongate tubular body having an interior shoelace-receiving space, the first receptacle having a proximal section, a distal section, and a clearance space gap section disposed between the proximal section and the distal section, and a cutting tool including a movable cutting implement having a cutting edge, the cutting tool configured to allow the cutting implement to advance through the clearance space gap section and effectuate a cutting action on an occupant of the gap section;

an aglet-attaching subassembly configured to receive an aglet-bearing shoelace and to process the aglet-bearing shoelace to effectuate attachment of the aglet to the shoelace;

the aglet-attaching subassembly including:

a second receptacle defining a hollow elongate tubular body having an interior shoelace-receiving space, and a heat applicator configured to apply heat to the aglet-bearing shoelace operably disposed in the second receptacle and to thereby induce a heat shrink relationship between the aglet and the shoelace.

* * * * *